US006168469B1

(12) United States Patent
Lu

(10) Patent No.: US 6,168,469 B1
(45) Date of Patent: Jan. 2, 2001

(54) ELECTRICAL CONNECTOR ASSEMBLY AND METHOD FOR MAKING THE SAME

(75) Inventor: Sidney Lu, Taipei (TW)

(73) Assignee: Hon Hai Precision Ind. Co., Ltd., Taipai Hsein (TW)

( * ) Notice: Under 35 U.S.C. 154(b), the term of this patent shall be extended for 0 days.

(21) Appl. No.: 09/417,259

(22) Filed: Oct. 12, 1999

(51) Int. Cl.[7] ..... H01R 13/648
(52) U.S. Cl. ..... 439/608; 439/76.1; 439/67
(58) Field of Search ..... 439/608, 701, 439/76.1, 67, 620

(56) References Cited

U.S. PATENT DOCUMENTS 5,647,768 * 7/1997 Messuri et al. ..... 439/620
5,795,191 * 8/1998 Preputnick et al. ..... 439/608
5,993,259 * 11/1999 Stokoe et al. ..... 439/608

* cited by examiner

*Primary Examiner*—Gary F. Paumen
(74) *Attorney, Agent, or Firm*—Wei Te Chung

(57) ABSTRACT

An electrical connector includes a dielectric housing, first and second contacts for electrically engaging with a mated electrical connector, third and fourth contacts for electrically engaging with an electrical device. A printed circuit board is received in the housing. The first and third contacts and the second and fourth contacts are electrically connected together via circuits of the printed circuit board, respectively. These contacts are soldered to the printed circuit board, wherein the first and third contacts are on a first face of the printed circuit board and the second and fourth contacts are on an opposite face thereof. The first and second contacts each further have a barb having an interference fit with the housing. The printed circuit board has a copper stripline disposed between the first and second faces, whereby crosstalk of signals transmitted between the first and third contacts and between the second and fourth contacts can be prevented.

9 Claims, 8 Drawing Sheets

ELECTRICAL CONNECTOR ASSEMBLY AND METHOD FOR MAKING THE SAME

BACKGROUND OF THE INVENTION

1. Field of the Invention

The present invention is related to an electrical connector assembly and method for making the same. The electrical connector assembly is particularly suitable for use in electrically interconnecting high frequency signal circuits on backplanes, daughter boards and other like substrates.

2. Description of the Prior Art

Following the development of communication and computer technology, a high density connector assembly with pins in a matrix arrangement is devised to construct a large number of signal transmitting paths for connecting two electrical devices.

Such a high density connector assembly can be referred to U.S. Pat. Nos. 4,846,727, 4,975,084, 5,066,236, 5,104,341, 5,286,212, 5,341,211, 5,496,183, 5,664,968 and 5,924,899.

These connector assemblies have a common disadvantage that their design and manufacturing are relatively complicated whereby they have a high cost.

Furthermore, as the transmitting speed of signals becomes faster and faster, crosstalk of signals between different signal paths becomes a serious problem. U.S. Pat. Nos. 4,846,727 and 5,664,968 address this problem; however, the solution thereof uses a number of metal plates interposed between every two modules of a receptacle connector of the assembly, which not only increases the cost but also complicates the manufacturing of the connector assembly. Moreover, as a header connector of the assembly does not have shielding effectiveness, crosstalk between the signals may still happen.

Hence, an improved electrical connector assembly is needed to eliminate the above mentioned defects of current art.

SUMMARY OF THE INVENTION

Accordingly, an objective of the present invention is to provide an electrical connector assembly with good shielding effectiveness so that crosstalk of signals transmitted between different paths of the connector assembly can be effectively prevented.

Another objective of the present invention is to provide an electrical connector assembly having a low manufacturing cost.

Still another objective of the present invention is to provide an electrical connector assembly wherein electrical characteristics of signal transmitting paths of the connector assembly can be easily modified to meet different requirements.

A further objective of the present invention is to provide an electrical connector assembly wherein active/passive electrical components can be easily mounted in the connector assembly to achieve some special functions.

To fulfill the above mentioned objectives, according to one embodiment of the present invention, an electrical connector assembly consists of receptacle and header connectors for mating with each other. Each connector has an insulative housing defining a number of passageways therethrough. The passageways receive a corresponding number of connecting modules therein. Each connecting module includes a printed circuit board having two opposite faces each having a number of circuit traces thereon. Two copper striplines are integrally disposed in the printed circuit board between the two faces and connected to grounding circuit traces. An insulative layer is integrally disposed in the printed circuit board between the two copper striplines. A number of receptacle contacts are soldered to the two faces of each printed circuit board of the receptacle connector near a first side thereof. A number of eye-of-needle compliant pin contacts are soldered to the two faces of each printed circuit board of the receptacle connector near a second side thereof. Each receptacle contact is electrically connected with a corresponding compliant pin contact via a corresponding circuit trace. A number of pins are soldered to the two faces of each printed circuit board of the header connector near a first side thereof. A number of compliant pin contacts are soldered to the two faces of each printed circuit board of the header connector near a second side thereof. Each pin is electrically connected with a corresponding compliant pin contact via a corresponding circuit trace. The pins engage with the receptacle contacts. The compliant pin contacts are used for electrically connecting with electrical devices, such as a backplane for the receptacle connector and a daughter board for the header connector.

DETAILED DESCRIPTION OF THE PREFERRED EMBODIMENT

Reference will now be made in detail to the referred embodiments of the present invention.

Figure 1:
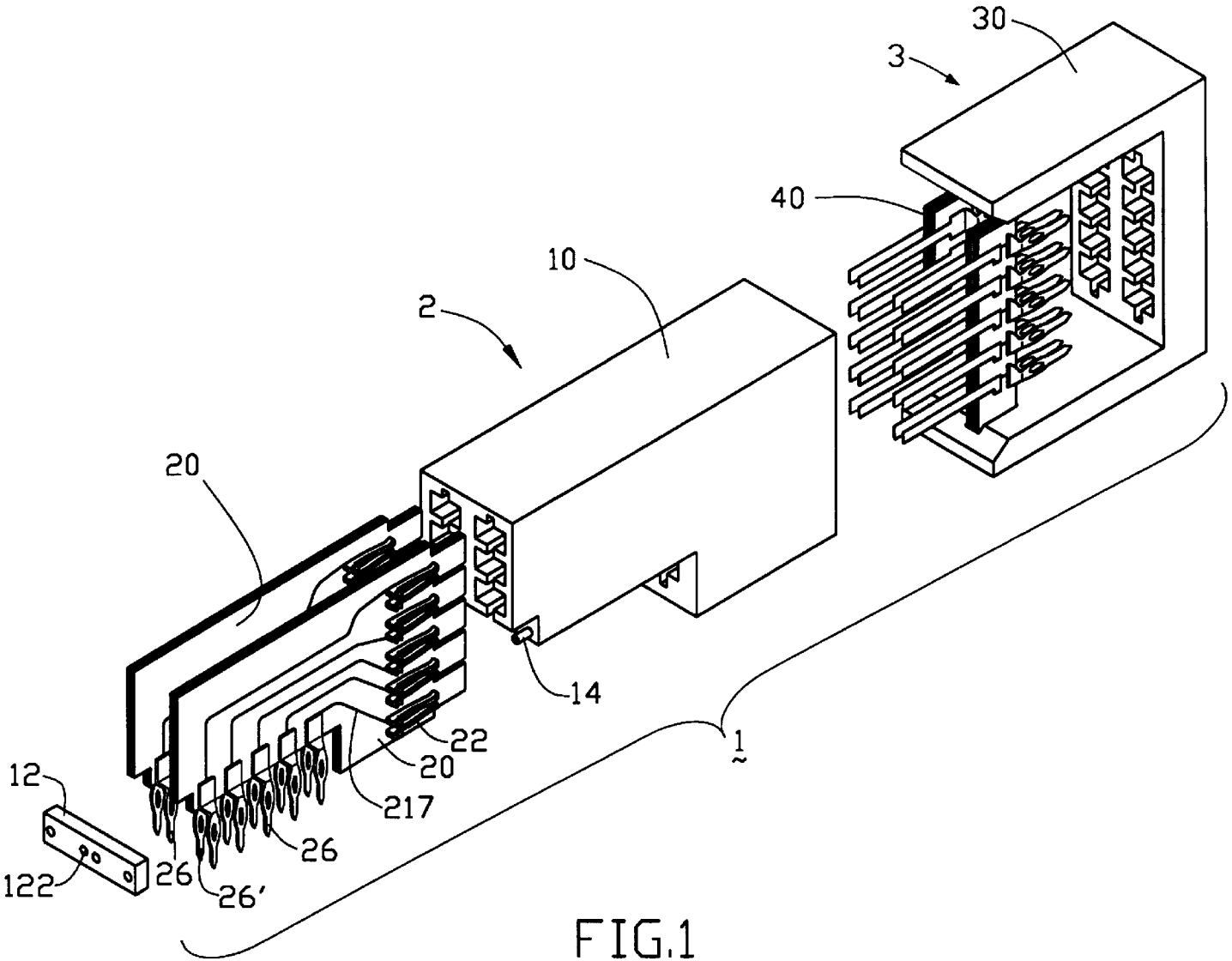
FIG. 1 is a perspective exploded view showing an electrical connector assembly in accordance with a first embodiment of the present invention.

Referring to FIG. 1, an electrical connector assembly 1 in accordance with a first embodiment of the present invention includes a receptacle connector 2 and a header connector 3.

The receptacle connector 2 includes a generally L-shaped dielectric housing 10, two connecting modules 20 and a fastening bar 12 made of plastics.

Figure 2:
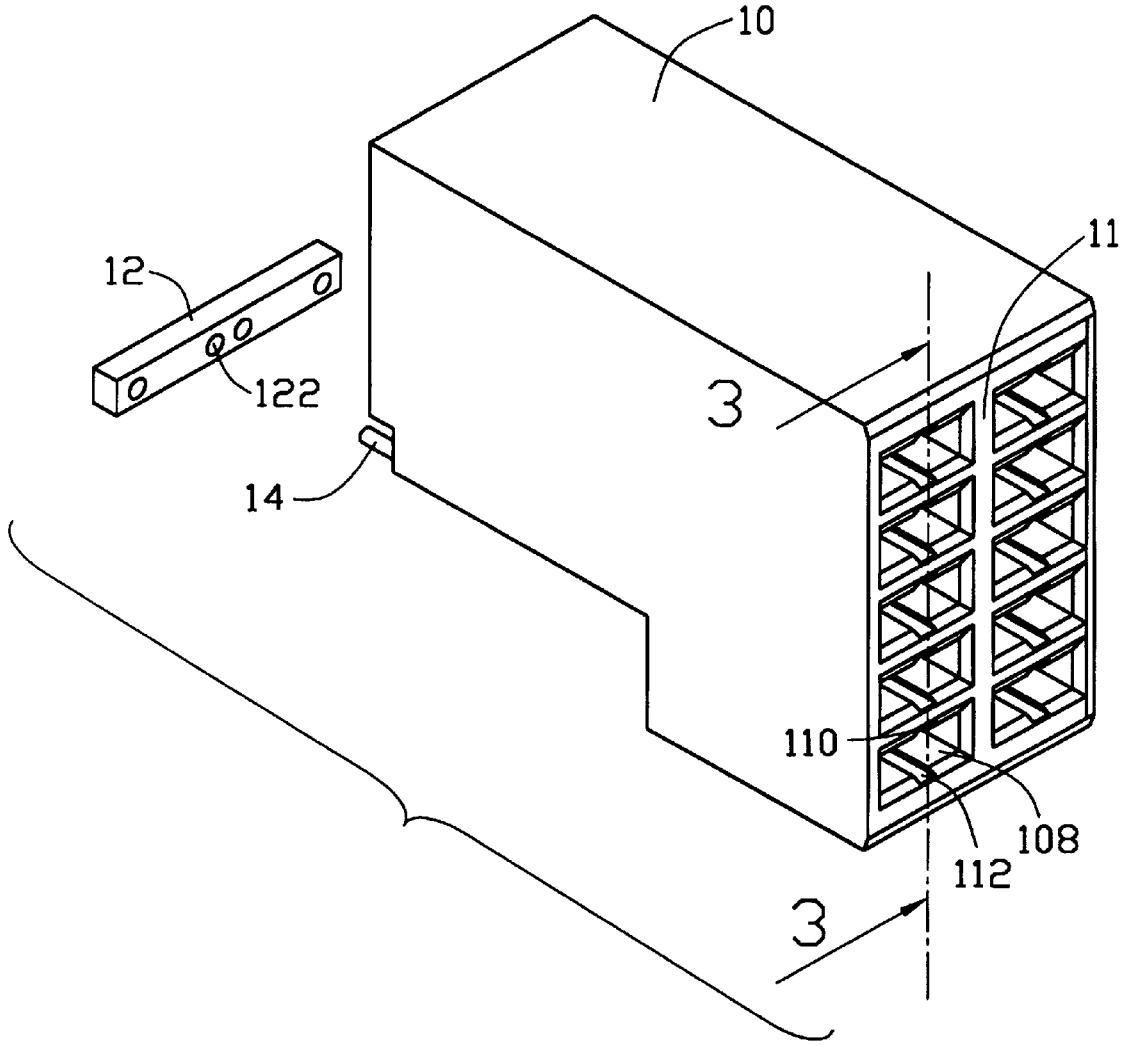
FIG. 2 is a perspective exploded view showing a housing and a fastening bar of a receptacle connector of the electrical connector assembly of FIG. 1.
Figure 3:
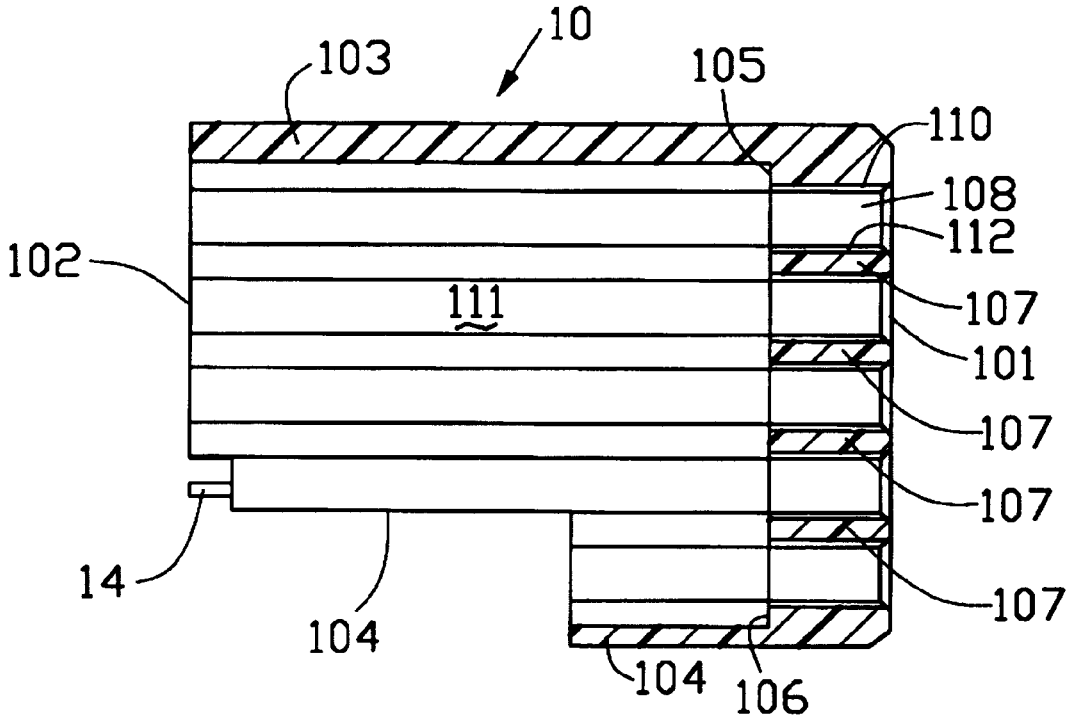
FIG. 3 is a cross-sectional view of the housing of FIG. 2 taken alone line 3—3 thereof.

Also referring to FIGS. 2 and 3, the housing 10 is made by plastics injection molding to have a middle vertical partition 11 lengthwise extending from a front side 101 of the housing 10 to a rear side 102 thereof to define two passageways 111 in the housing 10. Each passageway 111 is entirely opened to the rear side 102. The front side 101 of the housing 10 is used for engaging with the header connector 3. The housing 10 further has top and bottom walls 103, 104 between the front and rear sides 101, 102. The bottom wall 104 is used for proximity to an electrical device, for example, a backplane (not shown). Stops 105, 106 are respectively formed on the top and bottom walls 103, 104 near the front side 101. Four horizontal partitions 107 are equidistantly formed in the housing 10 between the top and bottom walls 103, 104 near the front side 101 to divide a front portion of the each passageway 111 into five contact receiving chambers 108. The housing 10 further defines upper and lower grooves 110, 112 in each chamber 108. The housing 10 integrally forms four mounting studs 14 (only one shown in FIGS. 1 and 3) at a bottom corner of the rear side 102.

Figure 4:
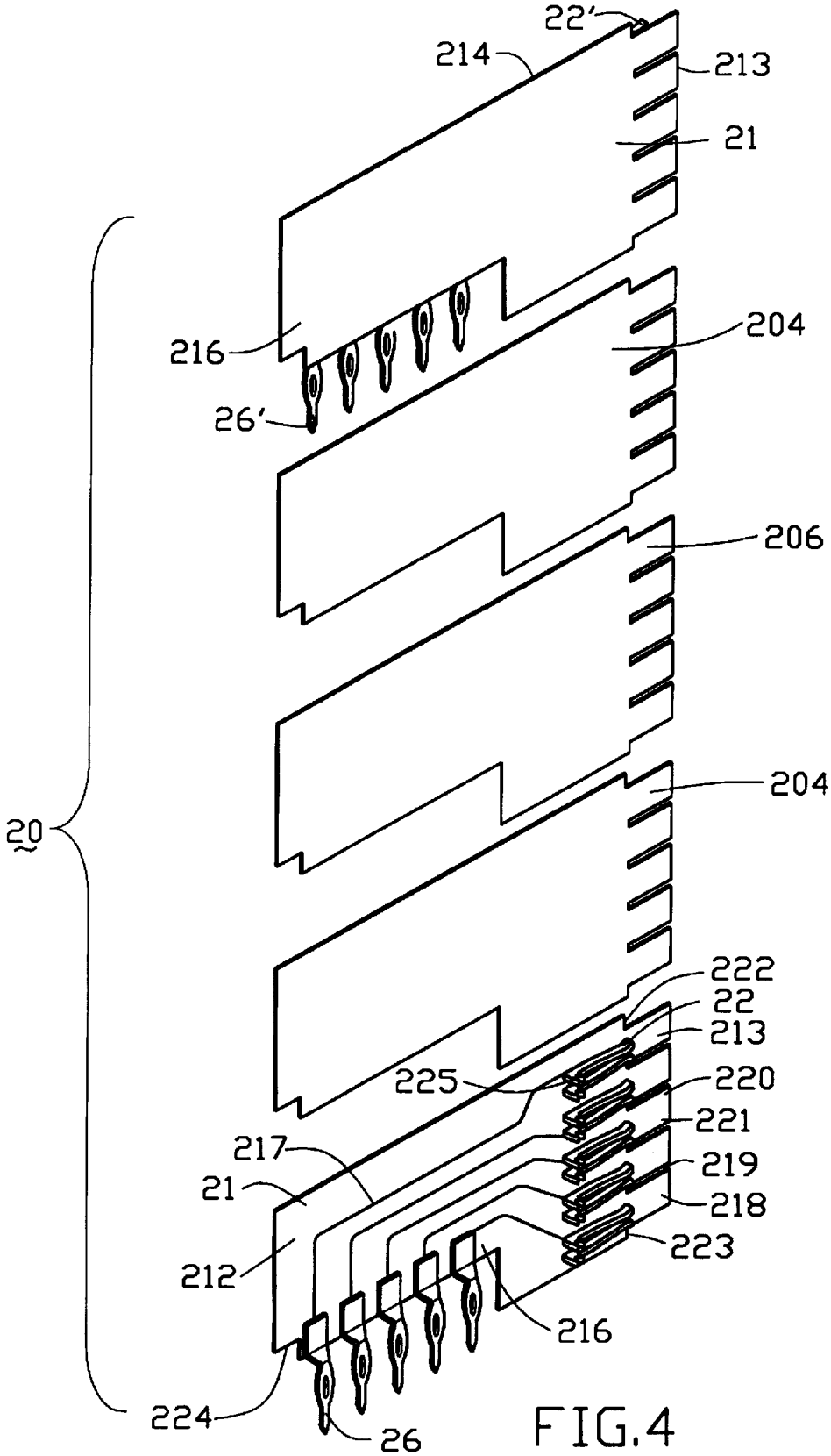
FIG. 4 is a perspective exploded view of a connecting module of the receptacle connector of the connector assembly of FIG. 1.

Referring to FIG. 4, each connecting module 20 for the receptacle connector 2 consists of a printed circuit board (hereafter PCB) 21, five receptacle contacts 22 soldered to a first face 212 of the PCB 21 equidistantly positioned along a front side 213 thereof and five more receptacle contacts 22' (only one shown) soldered to a second face 214 of the PCB 21 equidistantly positioned along the front side 213 thereof, wherein the second face 214 is opposite to the first face 212. Five eye-of-needle compliant pin contacts (hereafter compliant pin contacts) 26 are soldered to the first face 212 of the PCB 21 equidistantly positioned alone a bottom side 216 thereof. Five more compliant pin contact 26' are soldered to the second face 214 of the PCB 21 equidistantly positioned alone the bottom side 216 thereof. It can be understood that such compliant pin contacts 26, 26' are mounted to a main PC board (not shown) which the receptacle connector 2 is seated on and which is perpendicular to PCB 21. A circuit trace 217 electrically connects a corresponding receptacle contact 22 (22') and compliant pin contact 26 (26') together. Two copper striplines 204 are integrally disposed in the PCB 21 between the faces 212, 214. An insulative layer 206 is integrally disposed in the PCB 21 between the two copper striplines 204. Each copper stripline 204 is electrically connecting with a corresponding grounding circuit trace of the PCB 21. The PCB 21 is formed with five tabs 218 at its front side 213, equidistantly spaced from each other by a notch 219. Each tab 218 has upper and lower portions 220, 221. The PCB 21 further defines upper and lower steps 222, 223 at its upper and lower corners, respectively, adjacent to the front side 213.

To assemble the connecting modules 20 and the housing 10 together, each module 20 is inserted into a corresponding passageway 111 of the housing 10 from the rear side 102 thereof to reach a position wherein the upper and lower steps 222, 223 of the PCB 21 are blocked by the upper and lower stops 105, 106, respectively. Each tab 218 of the PCB 21 is extended into a corresponding contact receiving chamber 108 of the housing 10 so that each notch 219 receives a corresponding horizontal partition 107 therein. The upper and lower portions 220, 221 of each tab 218 are respectively fitted within the upper and lower grooves 110, 112 in the corresponding contact receiving chamber 108. Finally, the fastening bar 12 is mounted to the bottom corner of the rear side 102 of the housing 10 by extending the studs 14 through corresponding holes 122 (best seen in FIG. 2) in the fastening bar 12 to reach a position wherein the bar 12 closely abuts a rear, bottom depressed corner 224 (best seen in FIG. 4) of the PCB 21. Heat is then applied to a free end of each stud 14 protruding from the bar 12 to melt the free ends, thereby fixing the bar 12 to the housing 10. Thus, the connecting modules 20 are secured in the housing 10. Each receptacle contact 22 (22') forms barbs 225 engaging with the housing 10 to enhance the anchoring effectiveness of the contacts 22(22') in position in the housing 10.

Figure 5:
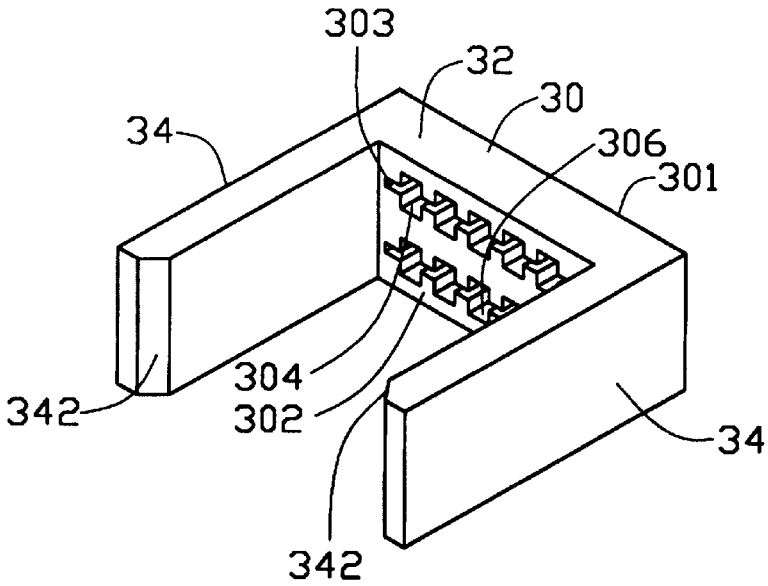
FIG. 5 is a perspective view of a housing of a header connector of the connector assembly of FIG. 1.

Referring to FIGS. 1 and 5, the header connector 3 includes a dielectric housing 30 generally having a U-shaped configuration with a base 32 and two upright side walls 34 for overlying the top and bottom walls 103, 104 of the housing 10 of the receptacle connector 2 when the header and receptacle connectors 3,2 are mated together. Each side wall 34 has an inclined surface 342 at its free end for facilitating the mating of the two connectors 2,3. The housing 30 defines two passageways 303 extending through top and bottom faces 302, 301 of the base 32 between the two side walls 34. Five contact receiving chambers 304 are equidistantly defined in each passageway. Each chamber 304 includes a pair of opposite recesses 306.

Figure 6:
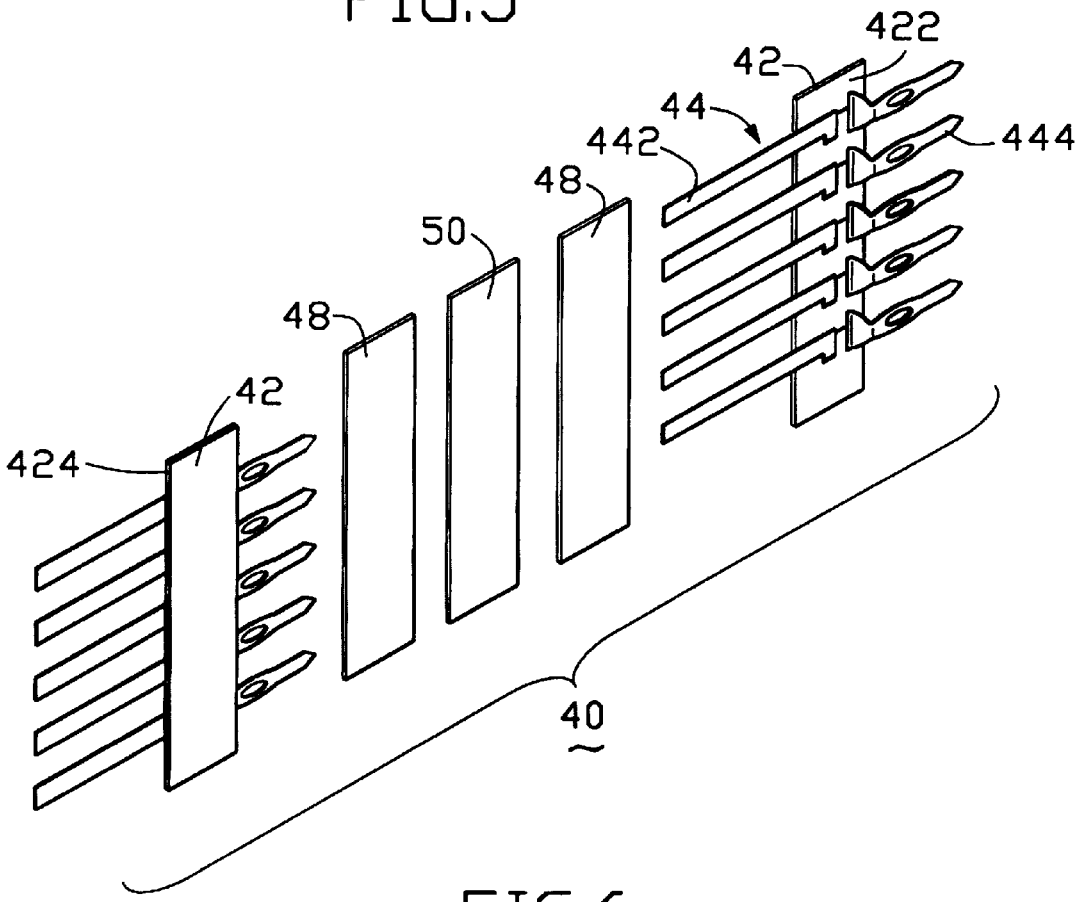
FIG. 6 is a perspective exploded view of a connecting module of the header connector of the connector assembly of FIG. 1.

Referring to FIG. 6, each connecting module 40 of the header connector 3 includes a PCB 42 with opposite first and second faces 422, 424. Two copper striplines 48 are integrally disposed in the PCB 42 between the two faces 422, 424. An insulative layer 50 is integrally disposed in the PCB 42 between the two copper striplines 48. Each face 422 (424) is attached with five contacts 44 each consisting of a pin 442 and a compliant pin contact 444 which are separately soldered to the PCB 42 and electrically connected with each other through a circuit trace (not labeled) on the PCB 42. The copper striplines 48 are electrically connected to grounding circuit traces of the PCB 42, respectively.

To form the header connector 3, the connecting modules 40 are sequentially assembled with the housing 30 by a manner that the PCBs 42 are respectively received in the passageways 303 to have an interference fit with the housing 30. The soldering portions of the pins 442 and compliant pin contacts 444 are received in the chambers 304. The pin 442 are extended beyond the top face 302 of the base 30 between the two side walls 34. The compliant pin contacts 444 are extended beyond the bottom face 301 of the base 30 for engaging with an electrical device, for example, a daughter board.

Figure 7:
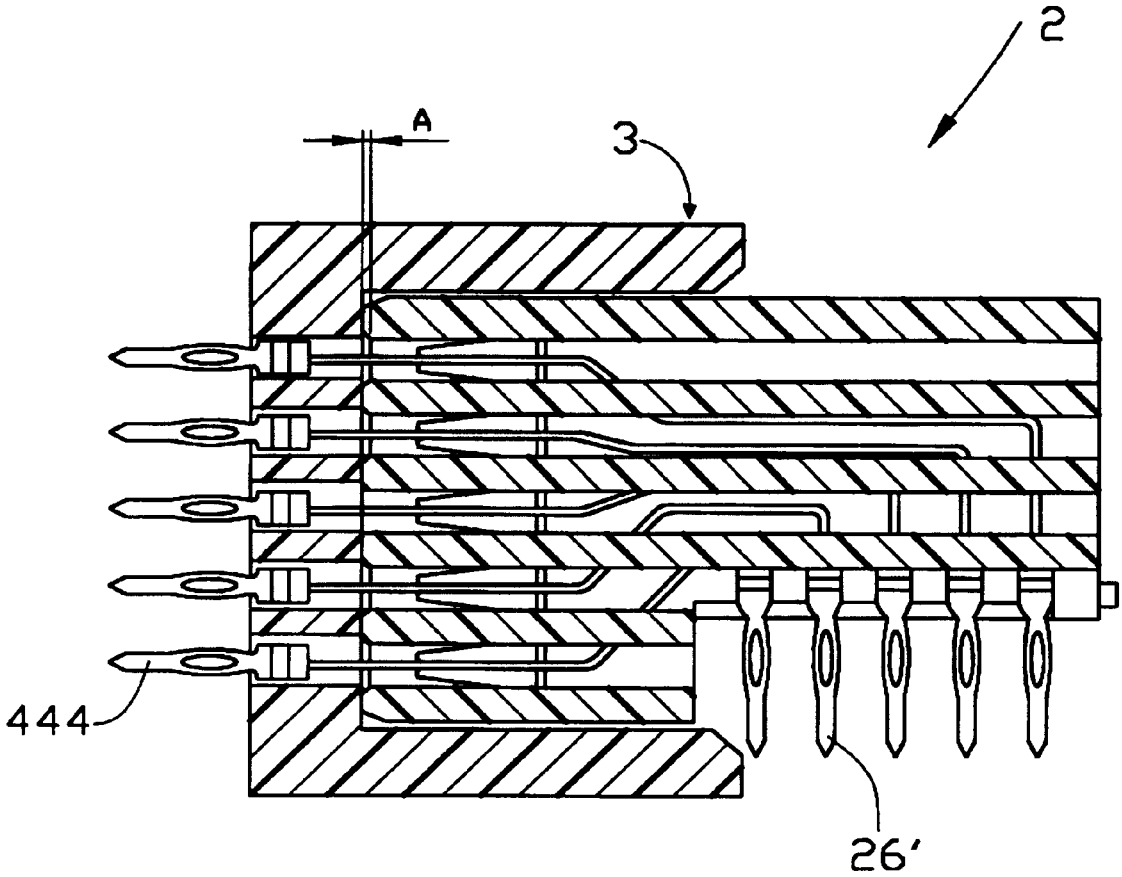
FIG. 7 is a cross-sectional view showing the connector assembly of FIG. 1 in a mated condition.

FIG. 7 shows that the receptacle and header connectors 3, 2 are connected together, wherein, except an out of board length "A", the transmitting path of signals from the electrical device engaging with the compliant pin contacts 444 of the header connector 3 to the electrical device engaging with the compliant pin contacts 26'(26) of the receptacle connector 2 is shielded by corresponding copper striplines 48, 204, in the PCBs 42, 21. Thus, crosstalk of the signals between different paths on two faces of each connecting module of the connector assembly can be effectively prevented.

Furthermore, as the signal transmitting paths of the present invention include printed circuit traces whose configuration can be easily modified by the process for making the PCBs 21, 42; thus, impedance of the signal transmitting paths created by the present invention can be easily adjusted to meet specific requirements of the electrical devices to be connected by the assembly 1.

Figure 8:
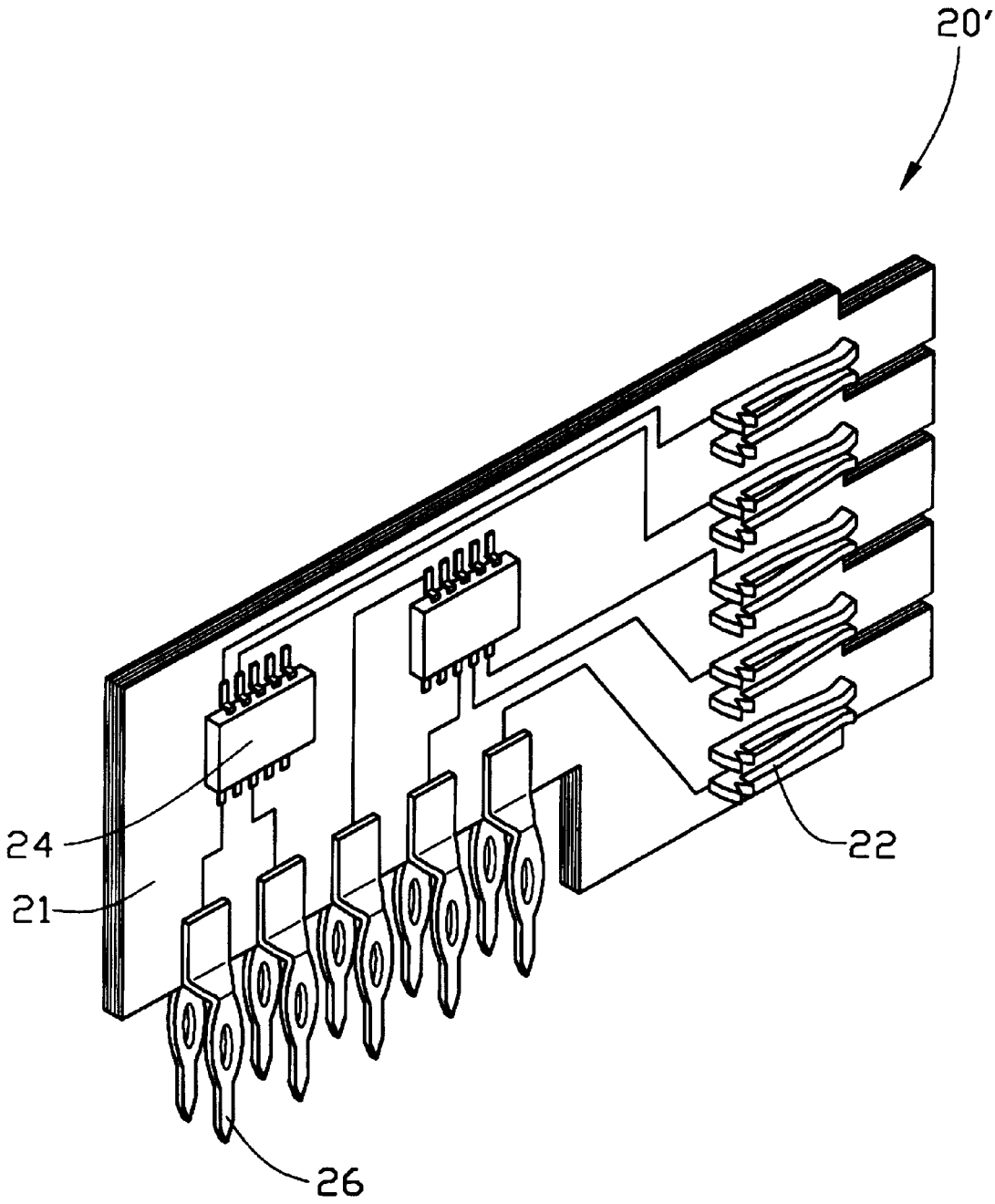
FIG. 8 is a perspective view of a connecting module of the receptacle connector in accordance with a second embodiment of the present invention.

FIG. 8 shows a connecting module 20' of the receptacle connector 2 in accordance with a second embodiment of the present invention in which some electronic active components such as bus arbitration logic chips 24 are attached to the PCB 21 between the receptacle contacts 22 and compliant pin contacts 26, whereby signals transmitted through the connector assembly 1 can be switched in a controlled manner. Although not shown in FIG. 8, it is known by those skilled in the art that some passive electrical components such as resistors or capacitors can be added to the connecting module 20' to modify the electrical characteristics of the signals transmitted through the connector assembly.

Figure 10:
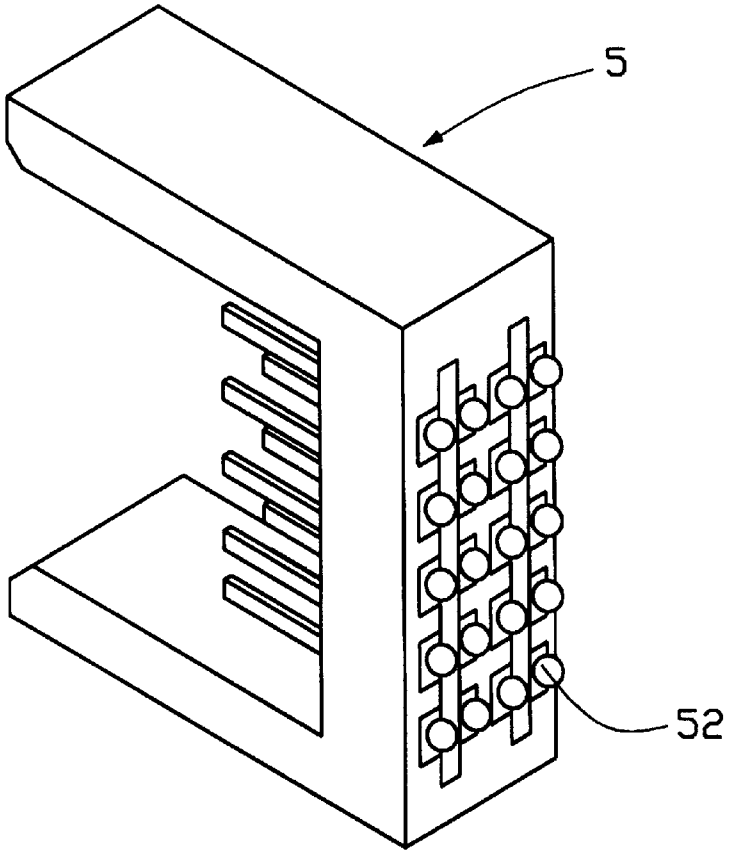
FIG. 10 is a header connector in accordance with the third embodiment of the present invention.
Figure 9:
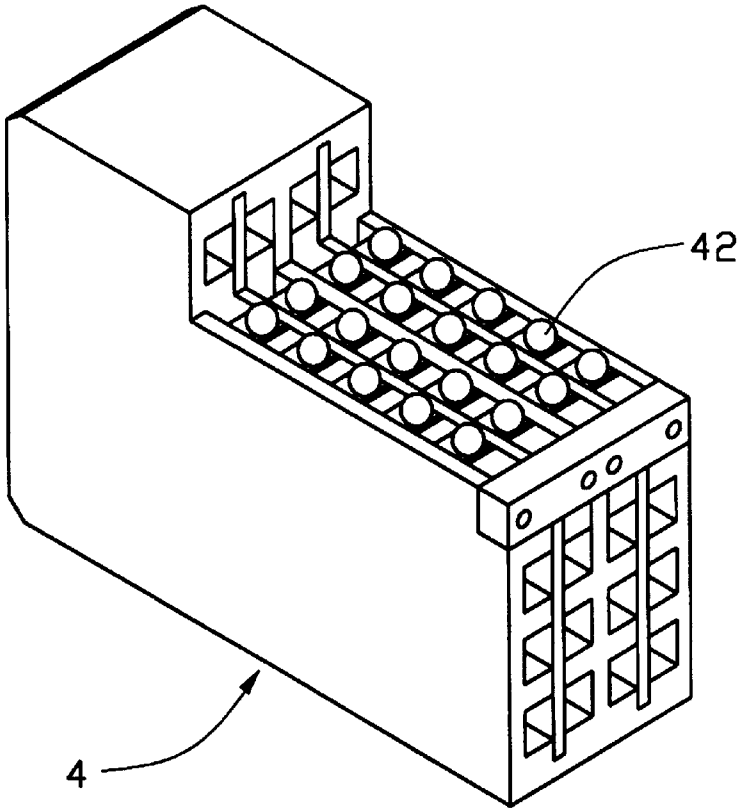
FIG. 9 is a receptacle connector in accordance with a third embodiment of the present invention.

FIG. 9 and 10 show receptacle and header connectors 4, 5 in accordance with a third embodiment of the present invention. Except the following differences, the third embodiment is substantially the same as the first embodiment: the compliant pin contacts 26, 26', 444 of the connectors 2, 3 of the first embodiment for electrically connecting electrical devices are replace by contacts attached with solder balls 42, 52. When subject to an infrared reflow process, the solder balls 42, 52 are melted to electrically and mechanically connect the connectors 4, 5 with corresponding electrical devices.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical connector, comprising:

a dielectric housing defining at least a passageway;

a connecting module received in the passageway, comprising:

a rigid printed circuit board;

first contact means electrically connected to the printed circuit board for electrically connecting with a first electrical device;

second contact means electrically connected to the printed circuit board for electrically connecting with a second electrical device, said first and second contact means being electrically connected with each other through circuit of the printed circuits board;

wherein said first contact means comprises first and second contacts respectively on opposite surfaces of the printed circuit board, said second contact means comprises third and fourth contacts respectively on the opposite surfaces of the printed circuit board, and said printed circuit board further comprises conductive grounding means between the opposite surfaces thereof for preventing crosstalk of signals transmitted between the first and third contacts and between the second and fourth contacts;

wherein the first contact means is used for connecting with a mating connector, and the second contact means is used for connecting with a printed circuit board;

wherein the connecting module further comprises an active or passive electrical component on the printed circuit board electrically connecting with the first and second contact means;

wherein the grounding means extends over an area substantially the same as that of one of the opposite surfaces of the printed circuit board.

2. The electrical connector in accordance with claim 1, wherein the second contact means comprises an eye-of-needle compliant pin contact.

3. The electrical connector in accordance with claim 1, wherein the second contact means comprises a contact attached with a solder ball.

4. The electrical connector in accordance with claim 1, wherein the grounding means is a copper stripline.

5. The electrical connector in accordance with claim 1, wherein the grounding means comprises two copper striplines sandwiching an insulative layer.

6. The electrical connector in accordance with claim 1, wherein the first contact means has fit means having an interference fit with the housing for securing the first contact means in position.

7. The electrical connector in accordance with claim 6, wherein the fit means comprises a barb formed on the first contact means.

8. An electrical connector assembly, comprising:

a first electrical connector, comprising:

a first dielectric housing; and a first electrical connecting module received in the first housing, comprising:

a first printed circuit board;

first and second contacts mounted to opposite surfaces of the printed circuit board about a first position, third and fourth contacts mounted to the opposite surfaces of the printed circuit board about a second position, the first and third contacts and the second and fourth contacts being electrically connected with each other via circuits on the printed circuit board;

first grounding means interposed in the first printed circuit for preventing crosstalk of signals transmitted between the first and third contacts, and between the second and fourth contacts;

first electrical device being electrically connected with the third and fourth contacts; and a second electrical connector, comprising:

a second dielectric housing;

a second electrical connecting module received in the second housing, comprising:

a second printed circuit board;

fifth contact and sixth contacts mounted to opposite surfaces of the second printed circuit board about a third position, seventh and eighth contacts mounted to the opposite surfaces of the second printed circuit board about a fourth position, the fifth and seventh contacts and the sixth and eighth contacts being electrically connected with each other through circuits on the second printed circuit board;

second grounding means interposed in the second printed circuit board for preventing crosstalk of signals transmitted between the fifth and seventh contacts and between the sixth and eighth contacts;

a second electrical device being electrically connected with the seventh and eighth contacts;

the fifth and sixth contacts being electrically connected with the first and second contacts, respectively.

9. The electrical connector assembly in accordance with claim 8, wherein each of the first and second electrical devices is a printed circuit board.

* * * * *